US009446614B2

(12) United States Patent
Sugai et al.

(10) Patent No.: US 9,446,614 B2
(45) Date of Patent: Sep. 20, 2016

(54) PRINTING APPARATUS AND PRINTING METHOD

(71) Applicant: SEIKO EPSON CORPORATION, Tokyo (JP)

(72) Inventors: Keigo Sugai, Suwa (JP); Masahisa Otake, Azumino (JP); Yoshikazu Hama, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/966,982

(22) Filed: Dec. 11, 2015

(65) Prior Publication Data

US 2016/0193859 A1 Jul. 7, 2016

(30) Foreign Application Priority Data

Jan. 5, 2015 (JP) ..... 2015-000274

(51) Int. Cl.
*B41J 2/21* (2006.01)
*B41J 11/00* (2006.01)
*B41J 25/00* (2006.01)

(52) U.S. Cl.
CPC ..... *B41J 25/001* (2013.01); *B41J 2/2114* (2013.01); *B41J 11/002* (2013.01)

(58) Field of Classification Search
CPC ..... B41J 2/175; B41J 2/2114; B41J 11/002; B41J 25/001
See application file for complete search history.

(56) References Cited

U.S. PATENT DOCUMENTS 8,215,761 B2 * 7/2012 Takezawa ..... B41M 7/0081 347/101
8,240,840 B2 * 8/2012 Usuda ..... B41J 11/002 347/102
8,827,403 B2 * 9/2014 Miyamoto ..... B41J 2/2114 347/14
9,044,971 B2 * 6/2015 Tsuchiya ..... B41J 11/002
9,073,306 B2 * 7/2015 Ohkawa ..... B41J 2/01
2008/0117246 A1 5/2008 Hoshino

FOREIGN PATENT DOCUMENTS

JP 2006-150788 6/2006

* cited by examiner

*Primary Examiner* — Anh T. N. Vo
(74) *Attorney, Agent, or Firm* — Workman Nydegger

(57) ABSTRACT

A printing apparatus includes a head that discharges ink to a printing region, and causes ink dots formed on the printing region to be cured to form a line image in a first direction, and a movement section that that causes the printing medium to move relative to the head in a second direction intersecting the first direction, in which the printing region is divided into a plurality of areas in the second direction, and the movement section alternately switches the area in which the line image is formed by the head between the plurality of areas while causing the printing medium to relatively move.

11 Claims, 13 Drawing Sheets

FIG. 3

| SCANNING NUMBER | AREA | LINE IMAGE | DISCHARGE Duty |
|---|---|---|---|
| 1 | FIRST AREA AR1 | A11 | 60% |
| 2 | SECOND AREA AR2 | A21 | 60% |
| 3 | FIRST AREA AR1 | B11 | 70% |
| 4 | SECOND AREA AR2 | B21 | 70% |
| 5 | FIRST AREA AR1 | C11 | 80% |
| 6 | SECOND AREA AR2 | C21 | 80% |
| 7 | FIRST AREA AR1 | D11 | 90% |
| 8 | SECOND AREA AR2 | D21 | 90% |
| 9 | FIRST AREA AR1 | A12 | 40% |
| 10 | SECOND AREA AR2 | A22 | 40% |
| 11 | FIRST AREA AR1 | B12 | 30% |
| 12 | SECOND AREA AR2 | B22 | 30% |
| 13 | FIRST AREA AR1 | C12 | 20% |
| 14 | SECOND AREA AR2 | C22 | 20% |
| 15 | FIRST AREA AR1 | D12 | 10% |
| 16 | SECOND AREA AR2 | D22 | 10% |

PRINTING APPARATUS AND PRINTING METHOD

BACKGROUND

1. Technical Field

The present invention relates to a printing apparatus and a printing method that print an image in a printing region on a printing medium.

2. Related Art

In the related art, a printing apparatus is proposed, which performs band printing while intermittently transporting a printing medium in a transport direction by a predetermined delivery width (so-called one band). For example, in the apparatus disclosed in JP-A-2006-150788, band printing is performed while scanning using a recording head three times with respect to one band. The apparatus achieves suppression of gloss irregularities by randomly thinning the ink discharge from the recording head in the final scan of the three scans.

However, in the apparatus disclosed in JP-A-2006-150788, gloss irregularities in band units may occur. Even though gloss irregularities are suppressed in each band by randomly thinning the ink discharge, image quality of the image may be lowered by the thinning. For example, ink to be discharged per unit area may not be discharged from the recording head, and the desired tone may not be obtained. Spot defects may also occur.

SUMMARY

An advantage of some aspects of the invention is to provide a printing technology that prints a high quality image while suppressing the occurrence of gloss irregularities.

According to a first aspect of the invention, there is provided a printing apparatus that prints an image on a printing region of a printing medium, the apparatus including a head that discharges ink to the printing region, and cures ink dots formed on the printing region to form a line image in a first direction; and a movement section that causes the printing medium to move relative to the head in a second direction intersecting the first direction, in which the printing region is divided into a plurality of areas in the second direction, and the movement section alternately switching the area in which the line image is formed by the head between the plurality of areas while causing the printing medium to relatively move.

According to a second aspect of the invention, there is provided a printing method of printing an image on a printing region of a printing medium, the method including discharging ink to the printing region by a head, and curing ink dots formed on the printing region to form a line image in a first direction, and moving the printing medium relative to the head in a second direction intersecting the first direction in which the printing region is divided into a plurality of areas in a second direction, and the discharging of the ink is performed a plurality of times while alternately switching the area in which the line image is formed by the discharging of the ink between the plurality of areas while moving the printing medium.

In the invention configured in this way, the printing region in which the image is to be printed is divided into a plurality of areas. The image is printed while the formation of line images by the head is alternately switched between the plurality of areas. Accordingly, it is possible to suppress gloss irregularities between areas. The gloss irregularities caused by differences in the curing timing of ink can be dispersed in all printing regions, thereby reducing the gloss irregularities. As a result, it is possible to print a high quality image.

Here, the head may be configured to repeat a line layer forming operation in which the line layer is formed on the entire surface of the printing regions by forming line images in each area, and the plurality of line layers is layered on the printing region. In an image printed in this way, the formation state of the ink dots in a surfacemost line layer exerts a large influence on the gloss irregularity. Here, it is desirable for gloss irregularities to be suppressed while forming a line image included in the surfacemost line layer, that is, the surfacemost line image with a smaller number of ink dots than that of a line image other than the surfacemost line image. In other words, when the plurality of ink dots that configure the surfacemost line image are separated from one another in the first direction, it is possible for the gloss irregularities to be further reduced, which is suitable.

Because the influence exerted on the gloss irregularities increases approaching the surfacemost line layer, it is desirable for the number of ink dots for each line layer forming operation to be reduced toward the surfacemost line layer.

The form of dividing the printing region is arbitrary, and the printing region may be divided in two into a first area and a second area. In a case of printing an image by the head forming a first area line image by forming a first number of ink dots corresponding to the image on the first area, and forming a second area line image by forming a second number of ink dots corresponding to the image on the second area, the first area line image and the second area line image may be formed as follows. That is, the first area line image may be formed by forming the first line image while discharging ink with a number obtained by multiplying the discharge rate P1 (wherein, $0\%<P1<100\%$) by the first number on the first area, forming the second line image while discharging ink with a number obtained by multiplying the discharge rate P2 (wherein, $0\%<P2<100\%$) by the second number on the second area, and forming a third line image while discharging ink with a number obtained by multiplying the discharge rate (100−P1) by a first number on the first line image, and the second area line image may be formed by forming a fourth line image while discharging ink with a number obtained by multiplying the discharge rate (100−P2) by a second number on the second line image. In this way, the first area line image includes two line images (first line image and third line image) stacked, and is configured by a first number necessary for the image. This feature is the same for the second area line image. Accordingly, the desired image is obtained without the image quality being lowered.

In a case of forming the first area line image as described above, the third line is the surface layer side and exerts an influence on the gloss irregularity. Accordingly, it is desirable for the discharge rate P1 to be set to 60% or more, thereby suppressing gloss irregularities. This feature is the same for the second area line image. From the viewpoint of suppressing gloss irregularities on the entire printing region, it is desirable for the discharge rate P1 and discharge rate P2 to be set to the same value.

In a case where the printing region is divided in two as a first area and a second area, and printing is performed by the head having a print head that is able to freely reciprocate in a first direction, it is desirable for the following configuration to be used. The head is able to execute forward printing that forms a line image by discharging the ink from the print head while the print head is moved in the forward direction, and backward printing that forms a line image by discharging the ink from the print head while the print head is moved in the backward direction. Here, forward printing may be executed on the first area, and the backward printing may be executed on the second area. In this case, it is possible for differences in the curing timing of ink across all regions of each area to be suppressed, it is possible for gloss irregularities caused by differences in the curing timing to be more effectively suppressed, and it is possible to further increase the quality of an image.

As another example of a printing form using the head, a configuration may be used so that the movement section is able to execute a first movement operation in which the printing medium is relatively moved in order to switch the area for forming the line image by the head between the first area and the second area, and a second movement operation in which the printing medium is relatively moved with the area for forming the line image by the head being maintained as is. In this case, after the forward printing, the second movement operation, and the backward printing are executed to form a plurality of line images on one area of the first area and the second area, it is possible to perform a switch to the other area while the first movement operation is executed, and it is possible for the movement time to be longer than the second movement operation, and the number of first movement operations to be reduced, thereby achieving an improvement in the throughput.

It is possible to use a material that forms ink dots while being discharged to the printing region of the printing medium and is cured as the ink, and, for example, it is suitable to use a liquid that cures when irradiated with ultraviolet rays.

BRIEF DESCRIPTION OF THE DRAWINGS

The invention will be described with reference to the accompanying drawings, wherein like numbers reference like elements.

FIG. 3 is a drawing showing an example of a printing process using the printing apparatus shown in FIG. 1.

DESCRIPTION OF EXEMPLARY EMBODIMENTS

Hereafter, the first and second embodiments of the invention will be described with reference to the drawings. In each of the following drawings, because each ink dot and each member is given a visually recognizable size, the measurements of each ink dot and each member is shown made different to those used in practice.

Figure 1:
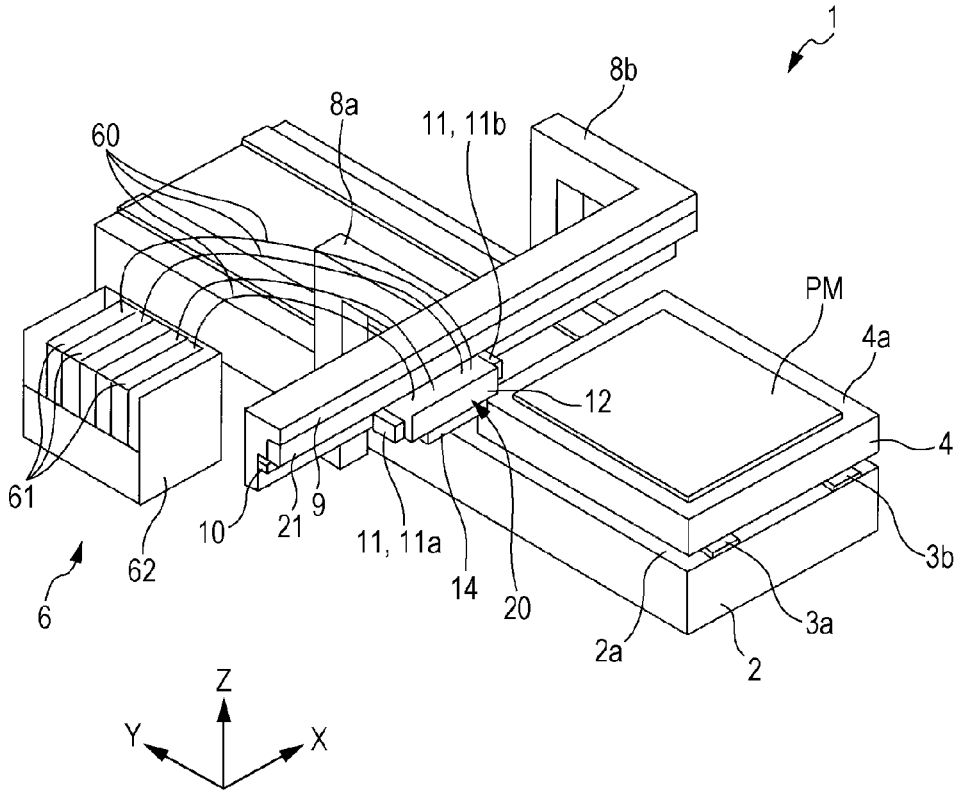
FIG. 1 is a drawing showing a configuration of a first embodiment of a printing apparatus according to the aspect of the invention.
Figure 2:
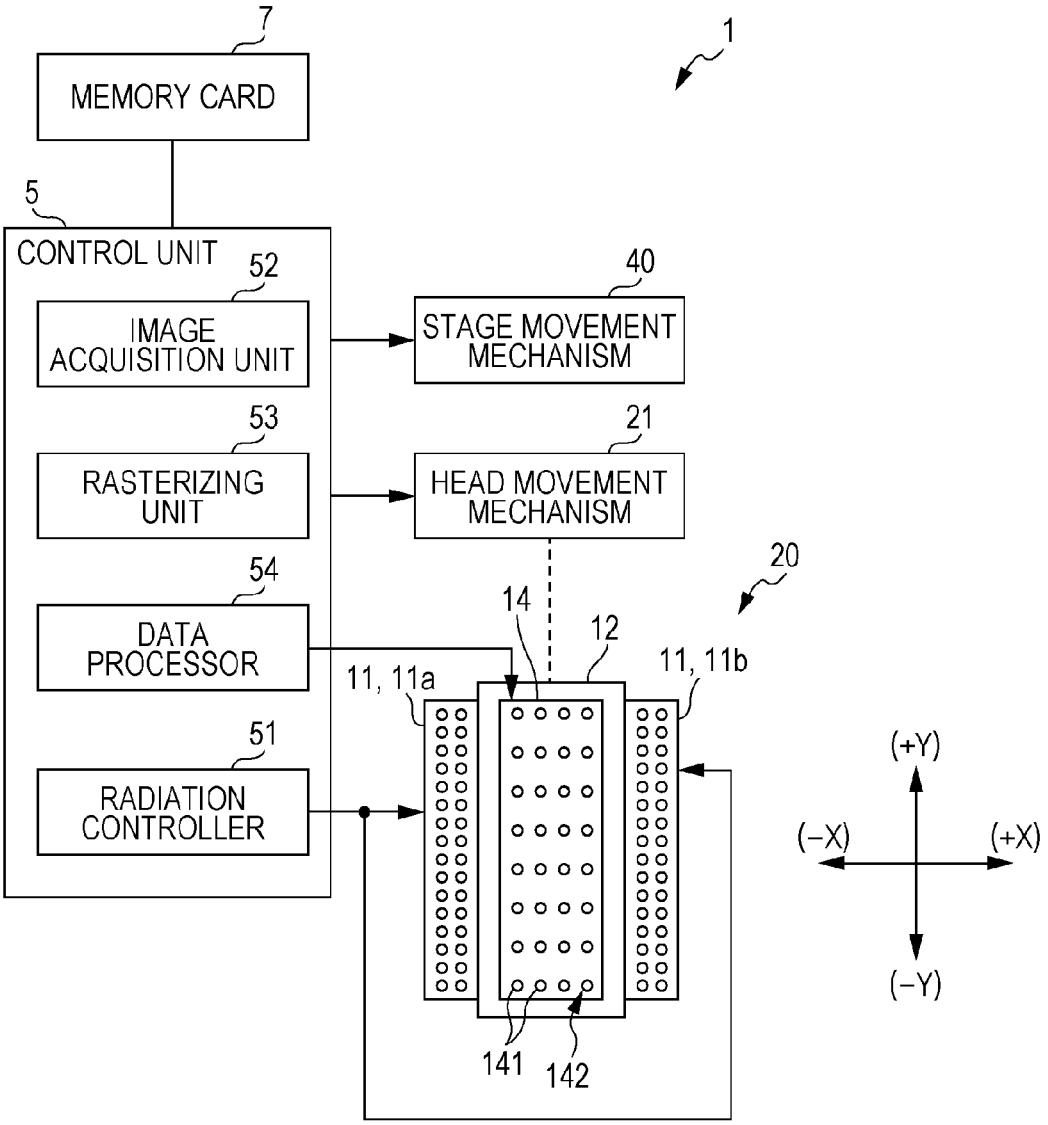
FIG. 2 is a schematic drawing showing a head and electrical configuration of the printing apparatus shown in FIG. 1.

FIG. 1 is a drawing showing an ink jet printing apparatus that is a first embodiment of the ink jet printing apparatus according to the invention. FIG. 2 is a schematic drawing showing a head and electrical configuration of the ink jet printing apparatus shown in FIG. 1. The printing apparatus 1 includes an ink set that including ultraviolet ray curable inks with four mutually differing colors, a print head that discharges ink from the ink set as droplets, and an ultraviolet ray radiating section that radiates ultraviolet rays. A control section that controls the driving of the various members is provided. A specific description is provided below.

As shown in FIG. 1, a base 2 formed in a rectangular parallelepiped is provided in the ink jet printing apparatus 1. In the embodiment, the length direction of the base 2 is the Y-axis direction, and the direction intersecting the Y-axis direction is the X-axis direction.

A pair of guide rails 3*a* and 3*b* extending in the Y-axis direction is provided along the entire width in the Y-axis direction on the upper surface 2*a* of the base 2. A stage 4 is provided on the upper side of the base 2 to freely reciprocate in the Y-axis direction by the pair of guide rails 3*a* and 3*b*. A stage movement mechanism 40 is connected to the stage 4. It is possible to use a screw-type linear motion mechanism provided with a screw shaft (drive shaft) extending along the guide rails 3*a* and 3*b* in the Y-axis direction, a Y-axis motor (not shown) by which the screw shaft is rotated, and a ball nut screwed to the screw shaft as the stage movement mechanism 40. When a drive signal corresponding to a predetermined number of steps is input from the control section 5 to the Y-axis motor, the Y-axis motor is forward driven or reversely driven, and the stage 4 moves forward or returns at a predetermined speed along the Y-axis direction (scans in the Y-axis direction) by an amount corresponding to the number of steps.

A mounting surface 4*a* to which the printing medium PM is mounted is formed on the upper surface of the stage 4. The invention is configured such that a suction-type work chuck mechanism is provided on the mounting surface 4*a*, and the printing medium PM is fixed to a predetermined position. The printing medium PM may be absorbent or may be non-absorbent, and is a plastic film (such as polyethylene (PE), polypropylene (PP), polyethylene terephthalate (PET), polycarbonate (PC), polyvinyl chloride (PVC), and polyvinyl alcohol (PVA)), various printing sheet, cardboard, a metal member (such as aluminum foil or copper foil) or the like. A coating layer, such as an absorbing layer, may be formed on the surface (printing surface) of the printing medium PM. Furthermore, various plastic films may be adhered together, and a deposition film may be formed on the surface of the metal member.

One of a pair of support stands 8*a* and 8*b* is arranged upright on both sides of the base 2 in the X-axis direction. A guide member 9 extending in the X-axis direction is installed across the pair of support stands 8*a* and 8*b*. The guide member 9 is formed to be longer than the width of the stage 4 in the X-axis direction. A guide rail 10 extending in the X-axis direction is provided on the lower side of the guide member 9 across the entire width in the X-axis direction.

A head 20 that includes a carriage 12 that is movable along the guide rail 10 is provided. The head movement mechanism 21 is connected to the head 20 (carriage 12). It is possible to use a similar configuration to the stage movement mechanism 40 as the head movement mechanism 21. That is, it is possible to use a screw-type linear motion mechanism provided with a screw shaft (drive shaft) extending along the guide rail 10 in the X-axis direction, an X-axis motor (not shown) by which the screw shaft is rotated, and a ball nut screwed to the screw shaft. When a drive signal corresponding to a predetermined number of steps is input from the control section 5 to the X-axis motor, the X-axis motor is forward driven or reversely driven, and carriage 12 of the head 20 moves forward or returns at a predetermined speed along the X-axis direction (scans in the X-axis direction) by an amount corresponding to the number of steps. In the specification, the (+X) axis direction is the "forward direction" of the head 20, and the operation that prints according to the forward movement of the head 20 as described layer is referred to as the "forward printing"; meanwhile the (−X) axis direction is the "backward direction" of the head 20, and the operation that prints according to the backward movement of the head 20 as described later is referred to as the "backward printing".

In this way, the print head 14 is mounted to the carriage 12 moved in the X-axis direction. The print head 14 is connected to the ink set 6 via a pipe 60, and is supplied with ink. The ink set 6 is the supply source of a liquid in which curing is promoted by irradiation with ultraviolet rays, that is, an ultraviolet ray curable ink. The ultraviolet ray curable ink is an ink including a pigment as a colorant and an ultraviolet ray curable resin component, and the solvent based ink is an ink including a pigment as a colorant or a solvent component such as water or an organic solvent in addition to a dye. These inks are stored in respective ink containers 61. The plurality of ink containers 61 is accommodated in a housing holder 62. Each ink container 61 and print head 14 corresponding to each ink container 61 are connected by a pipe 60, and are configured so that ink in the ink containers 61 is able to be supplied to the print head 14. In the embodiment, ink containers 61 in which cyan ink, magenta ink, yellow ink, and black ink are respectively accommodated are used in order to print a color image with cyan (C), magenta (M), yellow (Y), and black (K) for a total of four colors. However, the number of colors of ink or the types of ink can be variously modified.

Next, the configuration of the head 20 will be described. As shown in FIGS. 1 and 2, the head 20 is provided with a print head 14 that discharges various inks mounted to the ink set 6 as liquid droplets, and ultraviolet ray radiating sections 11 that radiate ultraviolet rays. In the embodiment, the ultraviolet ray radiating sections 11*a* and 11*b* area respectively arranged on both sides of the print head 14 (carriage 12) in the X-axis direction. The ultraviolet ray radiating sections 11*a* and 11*b* include a light source that emits ultraviolet rays. It is possible for the various light sources, such as an LED, an LD, a mercury lamp, a metal halide lamp, a xenon lamp, and an excimer lamp to be applied as the light source. When a lighting command is provided from the radiation controller 51 of the control section 5 to the ultraviolet ray radiating section 11*a*, the light source of the ultraviolet ray radiating section 11*a* is lit, and ultraviolet rays are radiated toward the mounting surface 4*a* (printing medium PM) of the stage 4. Meanwhile, when a lighting command is provided from the radiation controller 51 to the ultraviolet ray radiating section 11*b*, the light source of the ultraviolet ray radiating section 11*b* is lit, and ultraviolet rays are radiated toward the mounting surface 4*a* (printing medium PM) of the stage 4. In this way, in the embodiment, it is possible for ultraviolet rays to be selectively generated from the two ultraviolet ray radiating sections 11*a* and 11*b*, and for curing by the ultraviolet rays of the ultraviolet ray curable ink applied on the printing medium PM to be promoted.

The print head 14 includes a plurality of nozzles 141 in the surface facing the mounting surface 4*a* (printing medium PM) of the stage 4, as shown in FIG. 2. The plurality of nozzles 141 is configured by nozzle rows 142 (cyan nozzle row, magenta nozzle row, yellow nozzle row, black nozzle row) lined up substantially parallel to the transport direction Y of the printing medium PM. In the embodiment, the print head 14 performed forward printing according to the movement of the head 20 in the forward direction (+X); meanwhile, the print head 14 performs backward printing according to the movement of the head 20 in the backward direction (−X).

The control section 5 is configured by a CPU, a ROM, RAM, and EEPROM, not shown, being connected one another with a bus. The control section 5 functions as a controller that controls the operations of each part of the ink jet printing apparatus 1 (for example, the stage movement mechanism 40, the print head 14 or the like) by expanding and executing programs stored in the ROM or EEPROM in the RAM. The control section 5, other than functioning as a radiation controller 51 that controls the ultraviolet ray radiating sections 11 as described above, also functions as an image acquisition section 52, a rasterizer section 53, and a data processor 54. The processes that each of the functional units performs are described later. At least a portion of the functions realized b the CPU may be realized by an electrical circuit provided in the control section 5 operating based on the circuit configuration thereof. Reference numeral 7 in FIG. 2 is a memory card that stores the print source data (for example, vector data) pertaining to the image to be printed on the printing medium PM.

Next, the printing process using the above-described ink jet printing apparatus 1 will be described. Although the ink jet printing method of the embodiment prints the image stored on the memory card 7 on the printing region PR by sequentially forming the line images while performing the forward printing and the backward printing on the printing region PR (refer to FIG. 4) of the printing medium PR while the printing medium PM is intermittently moved in the transport direction Y, the embodiment greatly differs from the apparatus of the related art on the feature of having the next two technical characteristics.

The first technical characteristic is the feature of dividing the printing region PR of the printing medium PM into two areas AR1 and AR2 (refer to FIG. 4) having a width corresponding to the row length of the nozzle row 142 in the transport direction Y, and alternately switching the area in which the line image is formed by the print head 14 of the head 20 between the areas AR1 and AR2. In a case where the nozzle resolution of the print head 14 is 180 (dpi), and the printing resolution is 720 (dpi) in both the main scanning direction (X-axis direction) and the sub-scanning direction (Y-axis direction), forward printing or backward printing is performed four times, that is, four scans are necessary in order to form a 720 (dpi) image in the sub-scanning direction in each area AR1 and AR2.

The second technical characteristic is a feature where, although a desired image is printed with a plurality of line images formed by the head 20 arranged in the transport direction Y, either first area line image formed on the first area AR1 and the second area line image formed on the second area AR2 is formed with two scans. That is, each area line image is formed while layering the line image by the second scan with a comparatively low discharge Duty on a line image formed by the first scan with a comparatively high discharge Duty, rather than being formed with the first scan. Here, the "discharge Duty" is the proportion of the number of ink dots formed on the printing region PR while being discharged in practice from the nozzles 141 with respect to the number of ink dots necessary in order to form the area line image indicated as a percentage, and corresponds to the "discharge rate" in the invention. In the embodiment, the ink discharge from the print head 14 is controlled so that the sum of the first discharge Duty and the second discharge Duty is 100(%). That is, the head 20 prints the image according to the printing source data performed with the apparatus disclosed in JP-A-2006-150788, without performing so-called thinning.

Two scans divided into four scans for obtaining such a high resolution image, two scans for forming an area line image divided by discharge Duty (discharge rate), and further divided into two areas AR1 and AR2 are each necessary. Therefore, regarding the ink jet printing method of the embodiment, the printing of the image on the printing medium PM is performed with 16 scans (=4×2×2). That is, in the embodiment, the printing source data (vector data) stored on the memory card 7 is read out by the image acquisition section 52 and rasterized by the rasterizer section 53, thereby generating the raster data. The RGB format raster data is converted to ink amount data by the data processor 54 using a color conversion lookup table (not shown) provided in the EEPROM. In order to execute the printing operation reflecting the above technical characteristic, an interlacing process is performed on printing data taking the order in which the ink dots are formed by the print head 14 into consideration. The data processor 54 drives the X-axis motor, the Y-axis motor, the print head 14, and the like based on the printing data, and 16 scanning operations are executed as shown in FIG. 3. Thereby, as described next, each first area line image is formed on the first area AR1 with a number of ink dots corresponding to the image on the first area side (corresponding to the "first number" in the invention), and each second area line image is formed on the second area AR2 with a number of ink dots corresponding to the image on the second area side (corresponding to the "second number" in the invention), and thereby the image is printed.

FIG. 3 is a drawing showing an example of a printing process using the ink jet printing apparatus shown in FIG. 1. In the drawing, the wording "area" indicates the area in which the line image is formed by the head 20, and the wording "line image" indicates the line image formed by each scanning operation. Below, the operation of printing the image with the 16 scanning operations will be described with reference to FIGS. 4 to 9. For ease of understanding of the operation content, although a case of printing a solid image using only the black (K) ink from the four colors, that is, monochrome, as an example, a case of printing other colors or image forms is also the same.

FIGS. 4 to 9 are drawings schematically showing a printing operation by the ink jet printing apparatus shown in FIG. 1. In the drawings (and FIGS. 10 to 13 described later), the upper stages in each drawing is an operation view schematically showing the operation of the head 20 and the printing medium PM, the outlined arrow in the operation view indicates the X-axis direction movement of the head 20 by the head movement mechanism 21, and the black arrow indicates the Y-axis direction movement of the printing medium PM by the stage movement mechanism 40. The middle stage in each drawing is an expanded of the upper middle part R1 of the first area AR1 positioned on the upstream side in the transport direction Y, that is the (+Y) side from the two areas, and show an expanded planar view on the left side, and an expanded cross-sectional view on the right side. The lower stage in each drawing is an expanded of the upper middle part R2 of the second area AR2 positioned on the downstream side in the transport direction Y, that is, the (−Y) side from the two areas, and shows an expanded planar view on the left side, and an expanded cross-sectional view on the right side.

Figure 4:
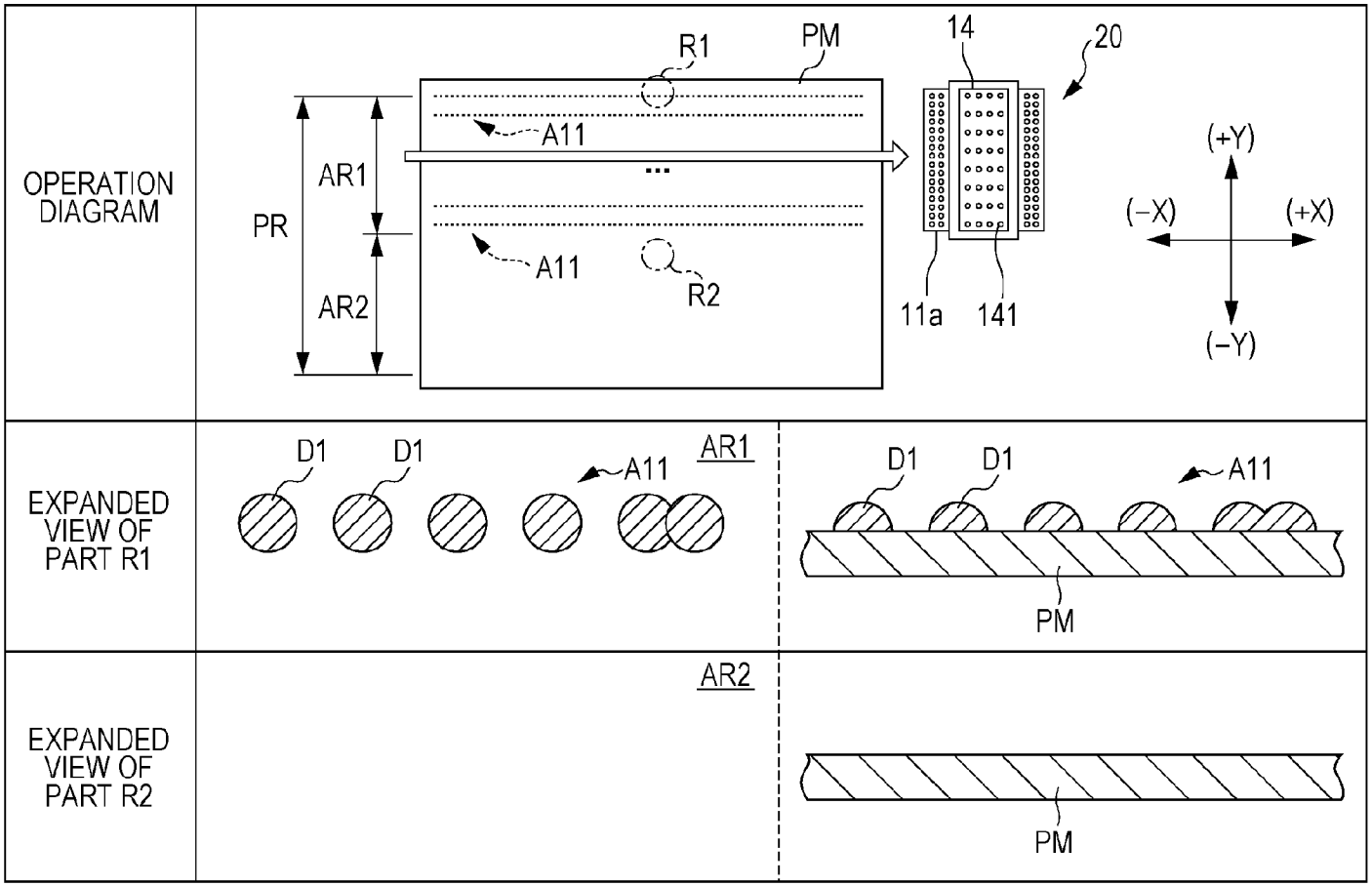
FIG. 4 is a drawing schematically showing the printing operation by the printing apparatus shown in FIG. 1.

Before the printing operation starts, the head 20 is positioned at the standby position separated from the stage 4 to the (−X) axis direction side, as shown in FIG. 1. When the control section 5 receives the start command for the printing operation, the printing operation is executed while controlling each section of the device as described below. That is, by the Y-axis motor being driven by the control section 5, the stage 4 moves in the (−Y) axis direction, and the stage 4 is positioned so that the first area AR1 of the printing medium PM is positioned vertically below the reciprocation path of the head 20. In so doing, the preparation for execution of the first scanning operation indicated by scanning number "1" in FIG. 3 is completed. Thus, ink is discharged in the form of droplets from the black nozzle 141 of the print head 14 toward the surface of the first area AR1 based on the printing data provided from the control section 5 while the head 20 moves in the forward direction, that is, in the (+X) direction. Thereby, the ink dots D1 are formed on the first area AR1 as shown in FIG. 4. The ultraviolet ray radiating section 11*a* is lit only while moving in the forward direction in conjunction with the movement in the (+X) axis direction of the head 20, and each ink dot D1 is irradiated with ultraviolet rays. In so doing, the line image A11 in the X-axis direction is formed as a first layer while curing each ink dot D1 (forward printing). In the first scanning operation, because the "discharge Duty" is set to 60% as shown in FIG. 3, although 40% of the ink dots are not formed at this stage, the line image (reference A12 in FIGS. 8 and 9) formed by these ink dots is formed layered on the line image A11 by the ninth scanning operation as described later.

Figure 5:
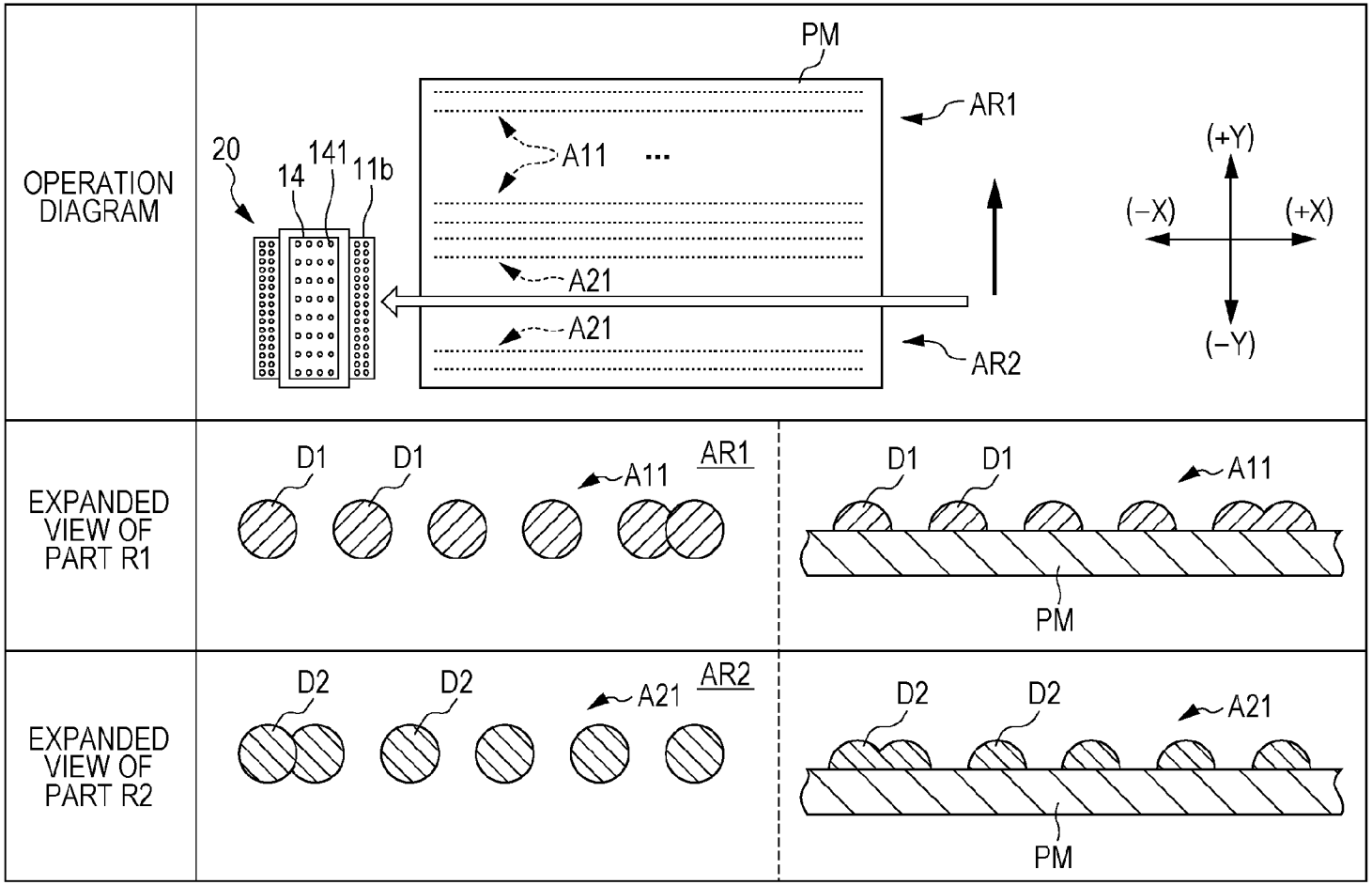
FIG. 5 is a drawing schematically showing the printing operation by the printing apparatus shown in FIG. 1.

At the point in time at which the first scanning operation is completed, on the second area AR2, the line image is first formed by execution of the second scanning operation indicated by the scanning number "2" in FIG. 3 without any of the line images being formed. That is, by the Y-axis motor being driven by the control section 5, the stage 4 moves in the (+Y) axis direction, and the stage 4 is positioned so that the second area AR2 of the printing medium PM is positioned vertically below the reciprocation path of the head 20. In so doing, the preparation for execution of the second scanning operation is completed. Thus, ink is discharged in the form of droplets from the black nozzle 141 of the print head 14 toward the surface of the second area AR2 based on the printing data provided from the control section 5 while the head 20 moves in the backward direction, that is, in the (−X) direction. Thereby, the ink dots D2 are formed on the second area AR2 as shown in FIG. 5. The ultraviolet ray radiating section 11*b* is lit only while moving in the backward direction in conjunction with the movement in the (−X) axis direction of the head 20, and each ink dot D2 is irradiated with ultraviolet rays. In so doing, the line image A21 in the X-axis direction is formed along with a line image A11 already formed on the first area AR1 as a first layer with each ink dot D2 cured, and the first line layer is configured by these line images A11 and A21. Also in the second scanning operation, 40% of the ink dots are not formed at this stage similarly to the first scanning operation, the line image (reference A22 in FIG. 9) configured by these ink dots is formed layered on the line image A21 by the tenth scanning operation as described later.

Figure 6:
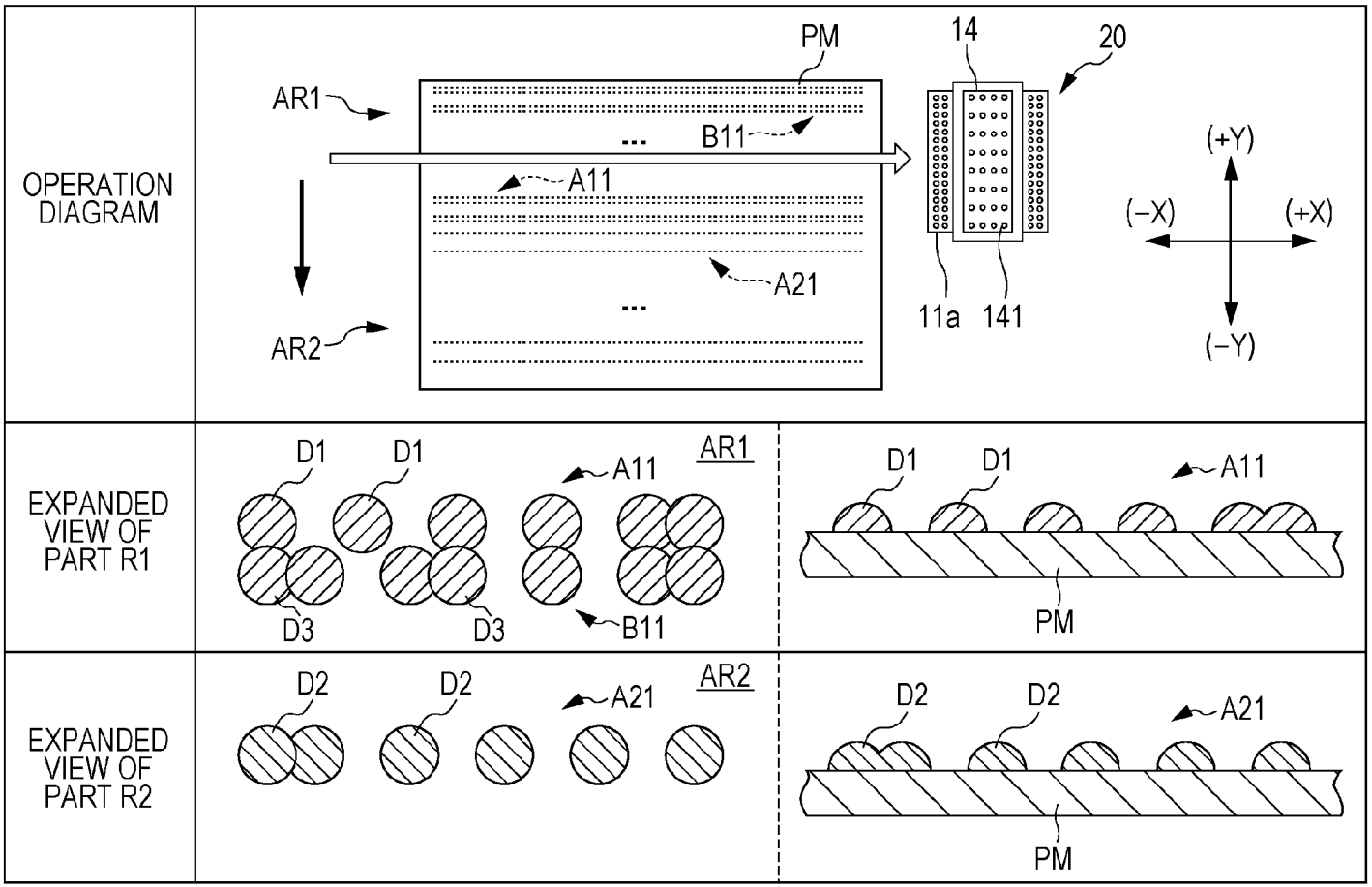
FIG. 6 is a drawing schematically showing the printing operation by the printing apparatus shown in FIG. 1.

When the second scanning operation is completed, by the Y-axis motor being driven in the reverse direction by the control section 5, the stage 4 moves in the (−Y) axis direction as shown in FIG. 6, and the stage 4 is positioned so that the first area AR1 of the printing medium PM is positioned vertically below the reciprocation path of the head 20 and shifted by one dot further in the (+Y) axis direction than during the first scanning operation. In this way, the preparation for execution of the third scanning operation indicated by scanning number "3" in FIG. 3 is completed. Thus, ink is discharged from the black nozzle 141 of the print head 14 toward the surface of the first area AR1 based on the printing data provided from the control section 5 while the head 20 moves in the forward direction, that is, in the (+X) direction. In this way, the ink dots D3 are formed so as to partially overlap the line image A11 on the first area AR1 as shown in FIG. 6. The ultraviolet ray radiating section 11*a* is lit only while moving in the forward direction in conjunction with the movement in the (+X) axis direction of the head 20, and each ink dot D3 is irradiated with ultraviolet rays. In so doing, the line image B11 in the X-axis direction is formed as a second layer while curing each ink dot D3 (forward printing). In the third scanning operation, because the "discharge Duty" is set to 70% as shown in FIG. 3, although 30% of the ink dots are not formed at this stage, the line image (reference B12 in FIG. 3) configured by these ink dots is formed layered on the line image B11 by the eleventh scanning operation as described later.

Figure 7:
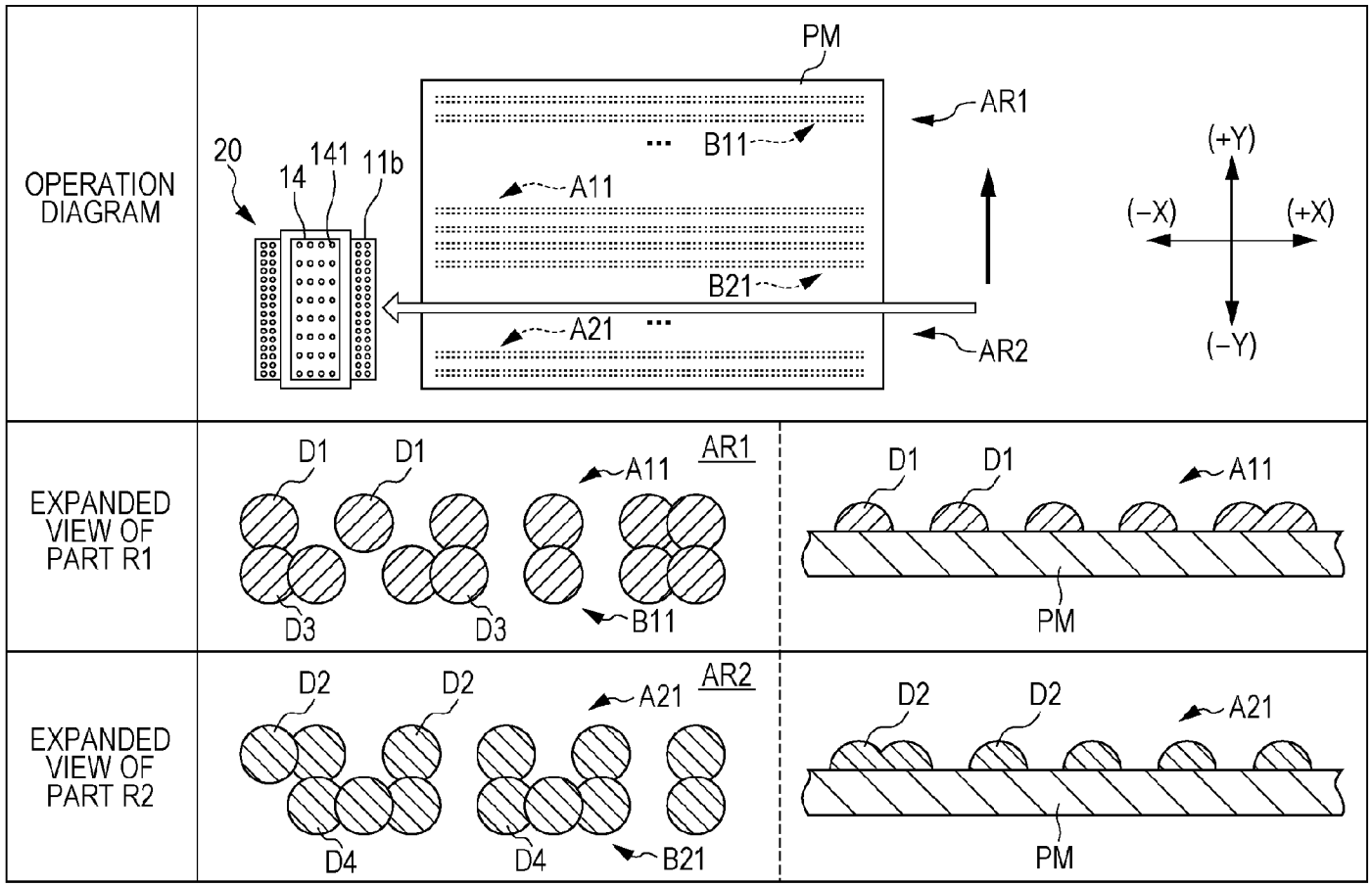
FIG. 7 is a drawing schematically showing the printing operation by the printing apparatus shown in FIG. 1.

By the Y-axis motor being driven by the control section 5 after the third scanning operation, as shown in FIG. 7, the stage 4 moves in the (+Y) axis direction, and the stage 4 is positioned so that the second area AR2 of the printing medium PM is positioned vertically below the reciprocation path of the head 20 and shifted by one dot further in the (+Y) axis direction than in the second scanning operation. In this way, the preparation for execution of the fourth scanning operation indicated by scanning number "4" in FIG. 3 is completed. Thus, ink is discharged from the black nozzle 141 of the print head 14 toward the surface of the second area AR2 based on the printing data provided from the control section 5 while the head 20 moves in the backward direction, that is, in the (−X) direction. In this way, the ink dots D4 are formed so as to partially overlap the line image A21 on the second area AR2 as shown in FIG. 7. The ultraviolet ray radiating section 11*b* is lit only while moving in the backward direction in conjunction with the movement in the (+X) axis direction of the head 20, and each ink dot D4 is irradiated with ultraviolet rays. In so doing, the line image B21 in the X-axis direction is formed along with a line image B11 already formed on the first area AR1 as a second layer while curing each ink dot D4 (backward printing). The second line layer is configured layered on the first line layer by the line images B11 and B21. In the fourth scanning operation, similarly to the third scanning operation, 30% of the ink dots are not formed at this stage, and the line image configured by these ink dots (line image B22 in FIG. 3) is formed layered on the line image B21 by the twelfth scanning operation.

By the transport of such a printing medium PM and the scanning operations indicated by the scan numbers "5" to "8" in FIG. 3 being repeated, the third line images C11 and C21 with a "discharge Duty" of 80% and the fourth line images D11 and D21 with a "discharge Duty" of 90% are formed. In the embodiment, after printing while forming the line image on the entire printing region PR at a comparatively high "discharge Duty", that is 60% or more, the scanning operations indicated by the scan numbers "9" to "16" in FIG. 3 corresponding to the reciprocating transport of the printing medium PM in the transport direction Y, that is, from the ninth to the sixteenth scanning operations are further executed.

Figure 8:
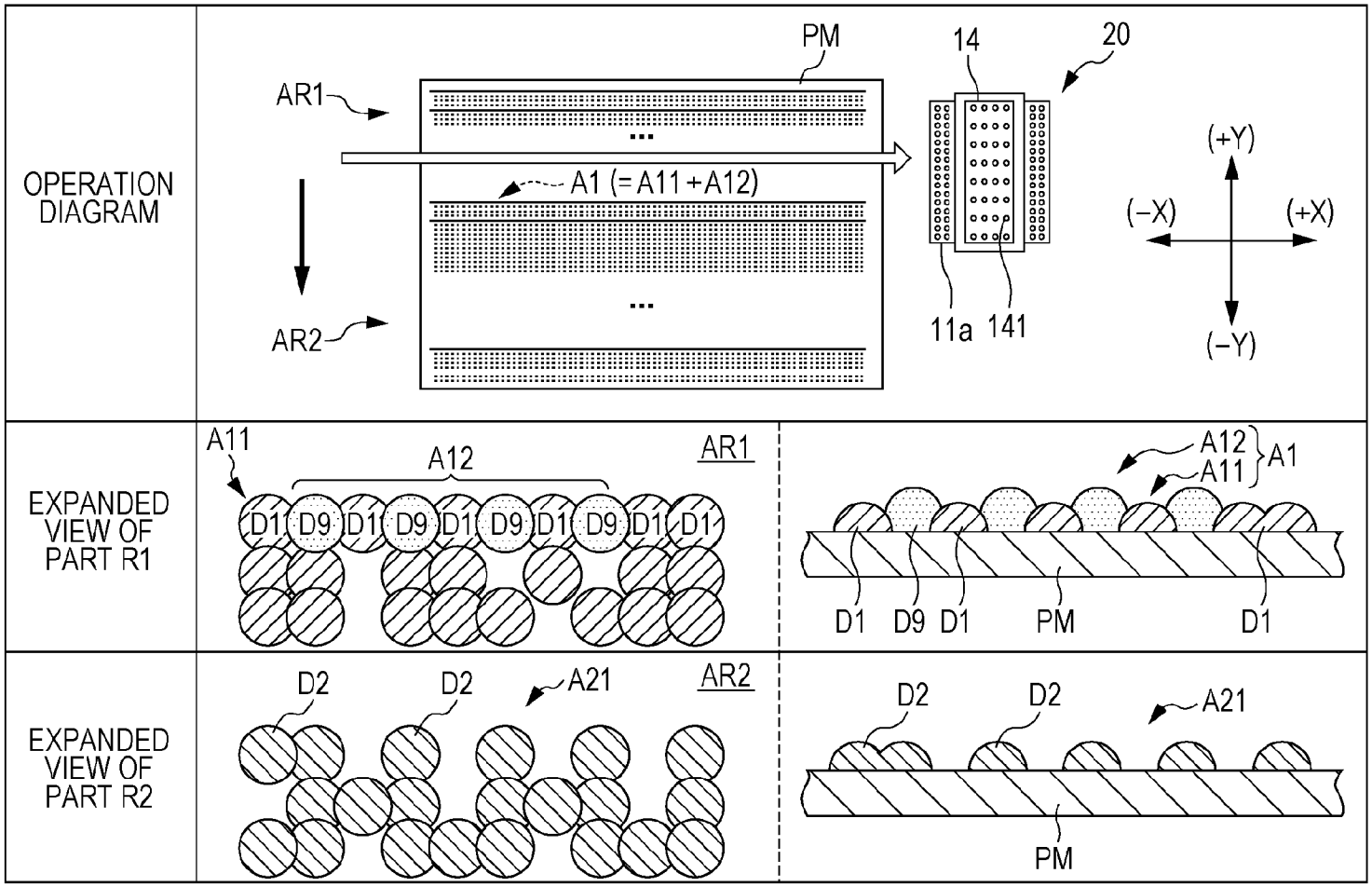
FIG. 8 is a drawing schematically showing the printing operation by the printing apparatus shown in FIG. 1.

By the Y-axis motor being driven by the control section 5, the stage 4 moves in the (−Y) axis direction as shown in FIG. 8, and the stage 4 is positioned so that the first area AR1 of the printing medium PM is positioned vertically below the reciprocation path of the head 20, and is at the same position in the Y-axis direction as during the first scanning operation. Subsequently, ink is discharged from the black nozzle 141 of the print head 14 toward the surface of the first area AR1 based on the printing data provided from the control section 5 while the head 20 moves in the forward direction, that is, in the (+X) direction. In this way, the ink dots D9 are formed on the line image A11 on the first area AR1. The ultraviolet ray radiating section 11*a* is lit only while moving in the forward direction in conjunction with the movement in the (+X) axis direction of the head 20, and each ink dot D9 is irradiated with ultraviolet rays. In so doing, the line image A12 in the X-axis direction is formed as a fifth layer while curing each ink dot D9 (forward printing). Here, 40% of the ink dots D9 not formed with the first scanning operation as described above are formed, and the first area line image A1 on which the line images A11 and A12 are stacked is formed.

Figure 9:
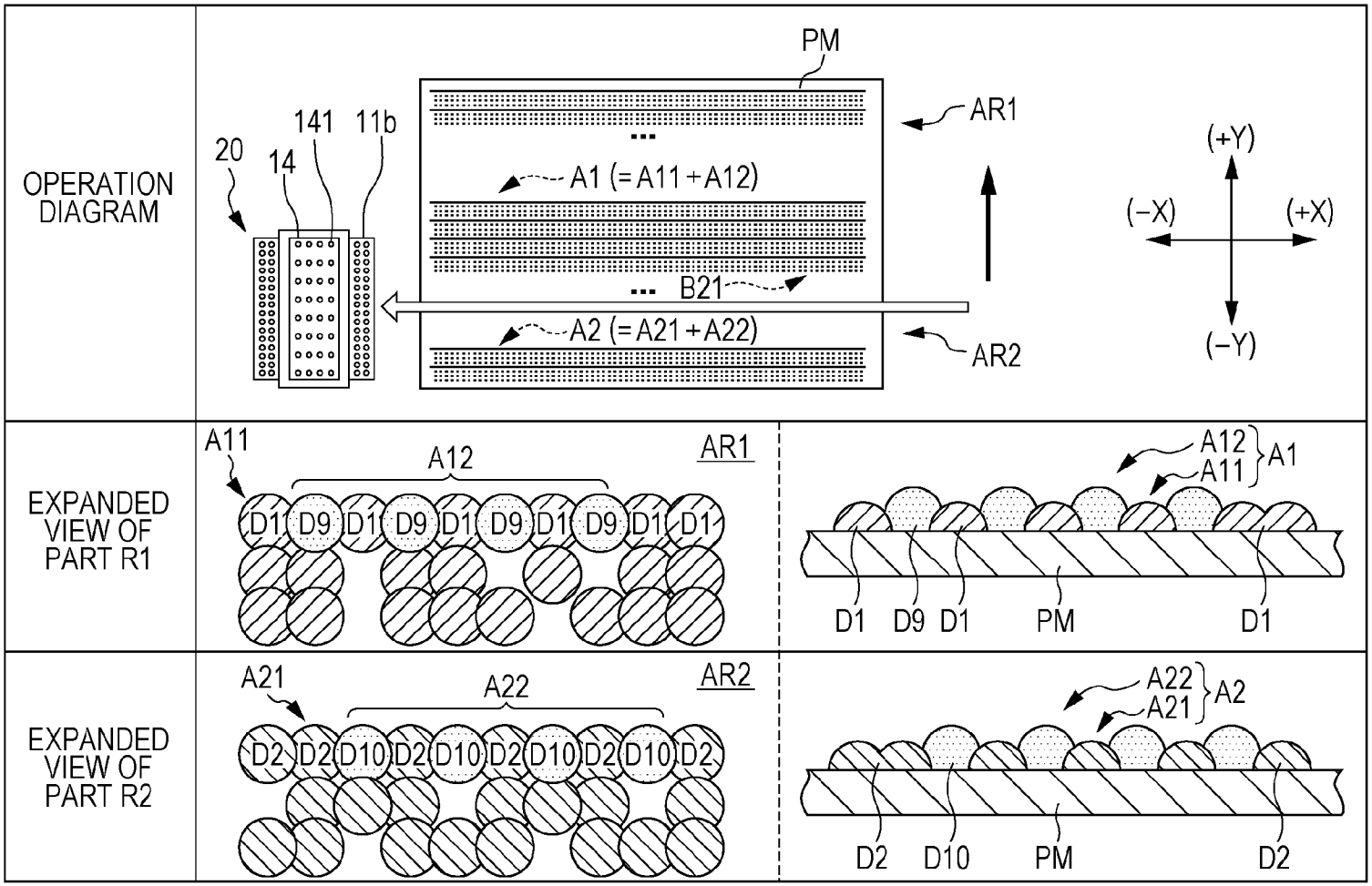
FIG. 9 is a drawing schematically showing the printing operation by the printing apparatus shown in FIG. 1.

After the ninth scanning operation, by the Y-axis motor being driven by the control section 5, the stage 4 moves in the (+Y) axis direction as shown in FIG. 9, and the stage 4 is positioned so that the second area AR2 of the printing medium PM is positioned vertically below the reciprocation path of the head 20 and at the same position as during the second scanning. Subsequently, ink is discharged from the black nozzle 141 of the print head 14 toward the surface of the second area AR2 based on the printing data provided from the control section 5 while the head 20 moves in the backward direction, that is, in the (−X) direction. The ink dots D10 are formed on the line image A21 on the second area AR2 by the tenth scanning operation. The ultraviolet ray radiating section 11*b* is lit only while moving in the backward direction in conjunction with the movement in the (+X) axis direction of the head 20, and each ink dot D10 is irradiated with ultraviolet rays. In so doing, the line image A22 in the X-axis direction is formed along with the line image A21 already formed on the first area AR1 as a fifth layer while curing each ink dot D10 (backward printing). Here, 40% of the ink dots D10 not formed with the second scanning operation as described above are formed, and the second area line image A2 on which the line images A21 and A22 are stacked is formed.

By the transport of the printing medium PM and the remaining eleventh to sixteenth scanning operations being repeated, the sixth to eighth line layers are formed and the first area line image and the second area line image are formed three at a time. That is, the line images B12 and B22 that configure the sixth line layer are formed layered on the line images B11 and B21, respectively, with a "discharge Duty" of 30%, and the first area line image (=B11+B12) and the second area line image (=B21+B22) are obtained. The line images C12 and C22 that configure the seventh line layer are formed layered on the line images C11 and C21, respectively, with a "discharge Duty" of 20%, and the first area line image (=C11+C12) and the second area line image (=C21+C22) are obtained. The line images D12 and D22 that configure the eighth line layer are formed layered on the line images D11 and D21, respectively, with a "discharge Duty" of 10%, and the first area line image (=D11+D12) and the second area line image (=D21+D22) are obtained.

As above, in the first embodiment, the printing region PR of the printing medium PM is divided into two areas AR1 and AR2 having a width corresponding to the row length of the nozzle row 142 in the Y direction as shown in FIG. 4. The line images A11, A21, . . . D12, and D22 are formed in the order while alternately switching the area forming the line image with the print head 14 of the head 20 between the areas AR1 and AR2. Therefore, the actions and effects below are obtained. When all line images are formed on the area AR1 and then all line images are formed on the area AR2 similarly to the apparatus disclosed in JP-A-2006-150788, the gloss irregularities between the areas AR1 and AR2 become large. Also within each area, gloss irregularities occur caused by the difference in curing timing. A lowering of image quality occurs in light of these causes. In contrast, in the embodiment, because the line images are alternately formed between areas, it is possible to greatly suppress the gloss irregularities between areas. All regions of the printing region PR are formed in the same raster order, and it is possible for the gloss irregularities caused by differences in the curing timings of the inks to be dispersed to all regions of the printing region PR, and it is possible to reduce the gloss irregularities. As a result, it is possible to print a high quality image.

In the first area AR1, all of the line images are formed by the forward printing as shown in FIGS. 4, 6 and 8. Therefore, the difference in curing timing of the ink across all regions of the first area AR1 becomes constant. This feature is the same for the second area AR2. That is, all of the line images are formed by backward printing as shown FIGS. 5, 7 and 9, and the difference in curing time of the ink across all regions of the second area AR2 becomes constant. As a result, it is possible for the gloss irregularities caused by differences in the curing timing to be more effectively suppressed, and possible to further increase the quality of the image.

In the embodiment, after the lower layer line image is formed with a comparatively high discharge Duty by the first to eighth scanning operations, an upper layer line image is formed layered on the lower layer line image with a comparatively low discharge Duty by the ninth to sixteenth scanning operations. Therefore, it is possible to suppress gloss irregularities in each of the areas AR1 and AR2.

The sum of the "discharge Duty" when forming the lower layer line image and the "discharge Duty" when forming the upper layer line image also becomes 100% in a case of forming either of the area line images. That is, in order to prevent gloss irregularities, thinning of the ink dots is not performed. Accordingly, according to embodiment, it is possible to print a high quality image without the occurrence of defects such as color tone defects or spot omissions that occur with the apparatus disclosed in JP-A-2006-150788.

In the embodiment, although an image is printed with the line layer (first layer) configured by the line images A11 and A21 as the first layer, and the line layer (second layer) configured by the line images B11 and B21, the line layer (third layer) configured by the line images C11 and C21, the line layer (fourth layer) configured by the line images D11 and D21, the line layer (fifth layer) configured by the line images A12 and A22, the line layer (sixth layer) configured by the line images B12 and B22, the line layer (seventh layer) configured by the line images C12 and C22, and the line layer (eighth layer, surfacemost layer) configured by the line images D12 and D22, stacked in this order thereupon, the "discharge Duty" is reduced approaching the surfacemost layer when forming each line layer, and the number of ink dots is reduced. Therefore, the ink dots are present in a dispersed state on the surface of the printed image, it is possible to satisfactorily suppress gloss irregularities. It is desirable to form the plurality of ink dots that configure the line images D12 and D22 included in the surfacemost layer so as to be separated from one another. Because the fifth to seventh layers are formed on the first to third layers respectively, it is desirable that the plurality of ink dots that configure the line images included in the fifth to seventh layers are also formed so as to be separated from one another, similarly to the surfacemost layer.

In each line layer, because formation of the ink dots is performed with the same "discharge Duty" in both areas AR1 and AR2, it is possible for the gloss irregularities caused by the curing timing of the ink to be dispersed in all regions of the printing region PR, and for the gloss irregularities to be reduced. Because the "discharge Duty" corresponding to each line layer are made different to one another, it is possible for the occurrence of periodic overlapping of ink dots to be suppressed. Thereby, the occurrence of gloss irregularities is suppressed.

FIGS. 10 to 13 are drawings schematically showing the printing operation of the second embodiment of the printing apparatus according to the invention. The feature in which the second embodiment differs greatly from the first embodiment is the order of the transport operation of the printing medium PM and the scanning operation, and the basic content of the configuration and the scanning operation of the ink jet printing apparatus 1 is the same as the first embodiment. Below, description is provided centering on the differing features, the same configurations are given the same reference numerals and will not be described.

In the first embodiment, when the relative movement path of the head 20 to the printing medium PM is seen from above the apparatus 1, the path is substantially spiral shape. That is, formation of the line image is performed once for each switching of the area. In contrast, in the second embodiment, the number of formations of the line images for each transport form different to the first embodiment and switching of the area is made different.

When the control section 5 receives the start command for the printing operation, the printing operation is executed while controlling each section of the device as described below. Although up to the completion of the second scanning operation is performed similarly to the first embodiment, thereafter the transport form of the printing medium PM and the scanning operation different to the first embodiment are performed.

Figure 10:
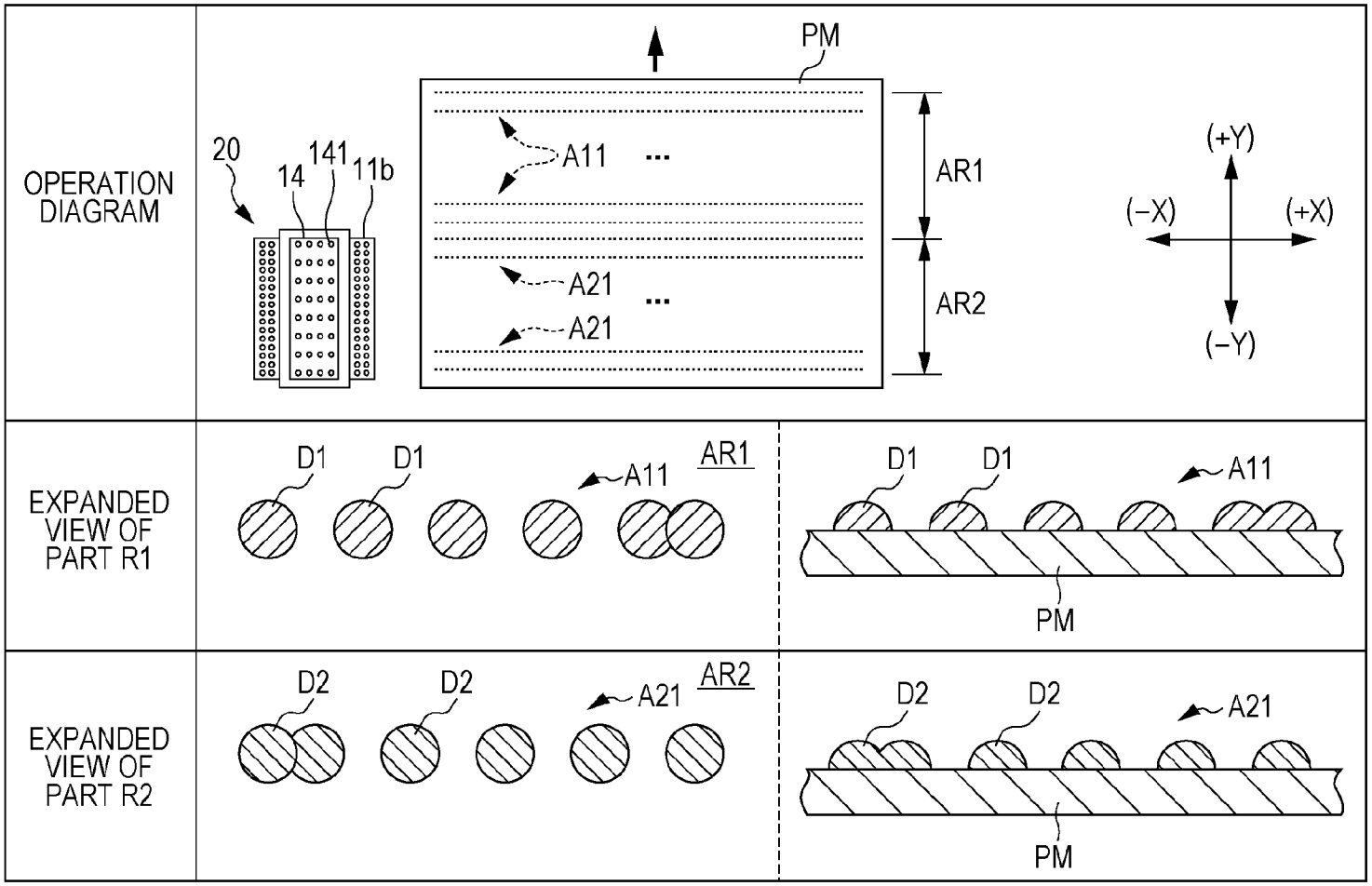
FIG. 10 is a drawing schematically showing the printing operation of a second embodiment of the printing apparatus according to the invention.

At the point in time at which the second scanning operation is completed, as shown in FIG. 5, the head 20 with which the line image A21 is formed is positioned at a position separated from the printing medium PM in the (−X) axis direction. In the first embodiment, next, the stage 4 moves in the (−Y) axis direction in order to switch the area in which the line image is formed from the second area AR2 to the first area AR1. In contrast, in the second embodiment, by the Y-axis motor being driven by the control section 5 as shown in FIG. 10, the stage 4 moves in the (+Y) axis direction, and the stage 4 is positioned so that the second area AR2 of the printing medium PM is positioned and shifted by one dot further in the (+Y) axis direction than in the second scanning operation.

Figure 11:
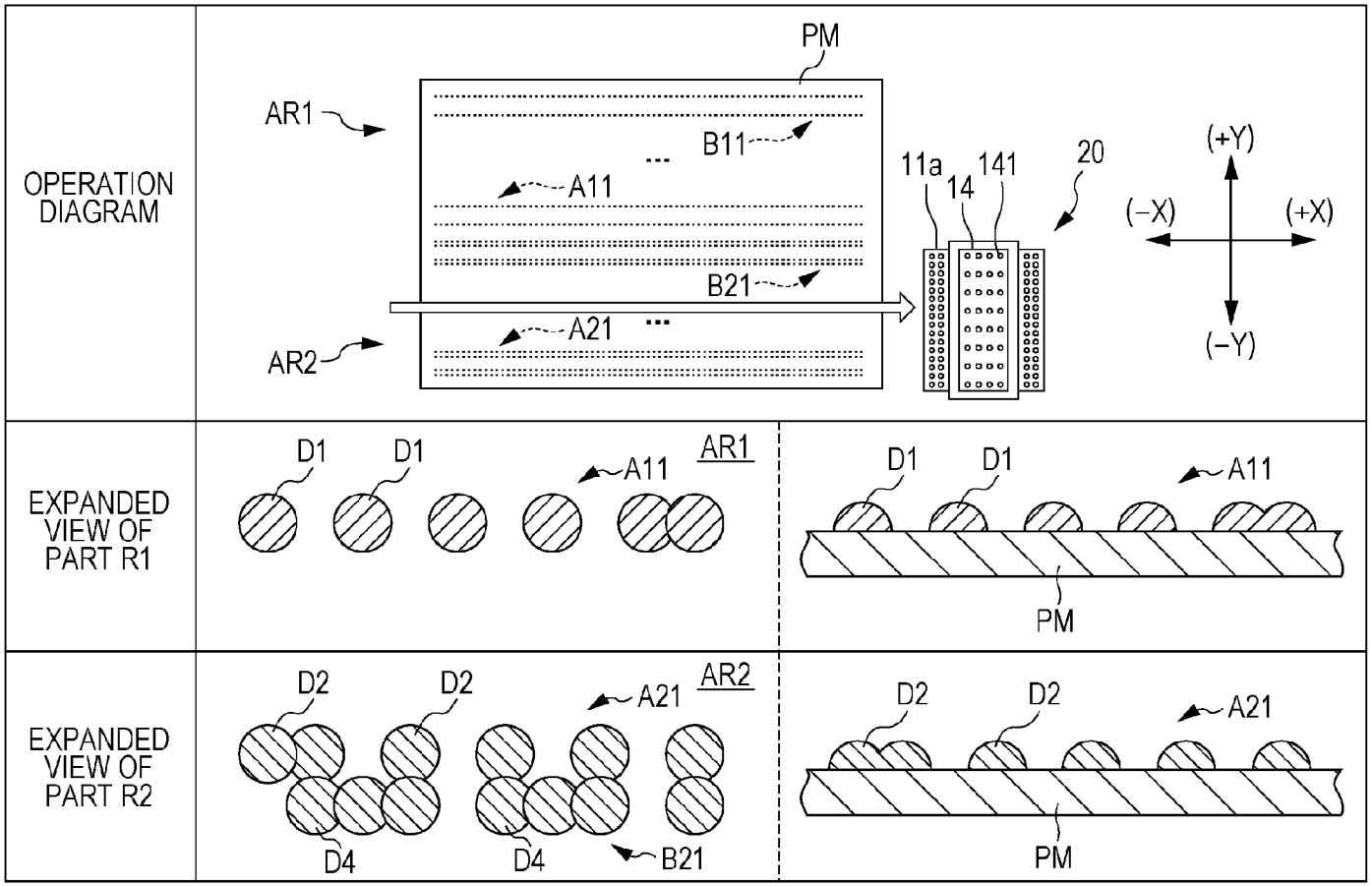
FIG. 11 is a drawing schematically showing a printing operation of the second embodiment of the printing apparatus according to the invention.

Subsequently, ink is discharged from the black nozzle 141 of the print head 14 toward the surface of the second area AR2 based on the printing data provided from the control section 5 while the head 20 moves in the forward direction, that is, in the (+X) direction. In this way, the ink dots D4 are formed so as to partially overlap the line image A21 on the second area AR2 as shown in FIG. 11. The ultraviolet ray radiating section 11*a* is lit only while moving in the forward direction in conjunction with the movement in the (+X) axis direction of the head 20, and each ink dot D4 is irradiated with ultraviolet rays. In so doing, the line image B21 in the X-axis direction is formed as a second layer while curing each ink dot D4 (forward printing).

Figure 12:
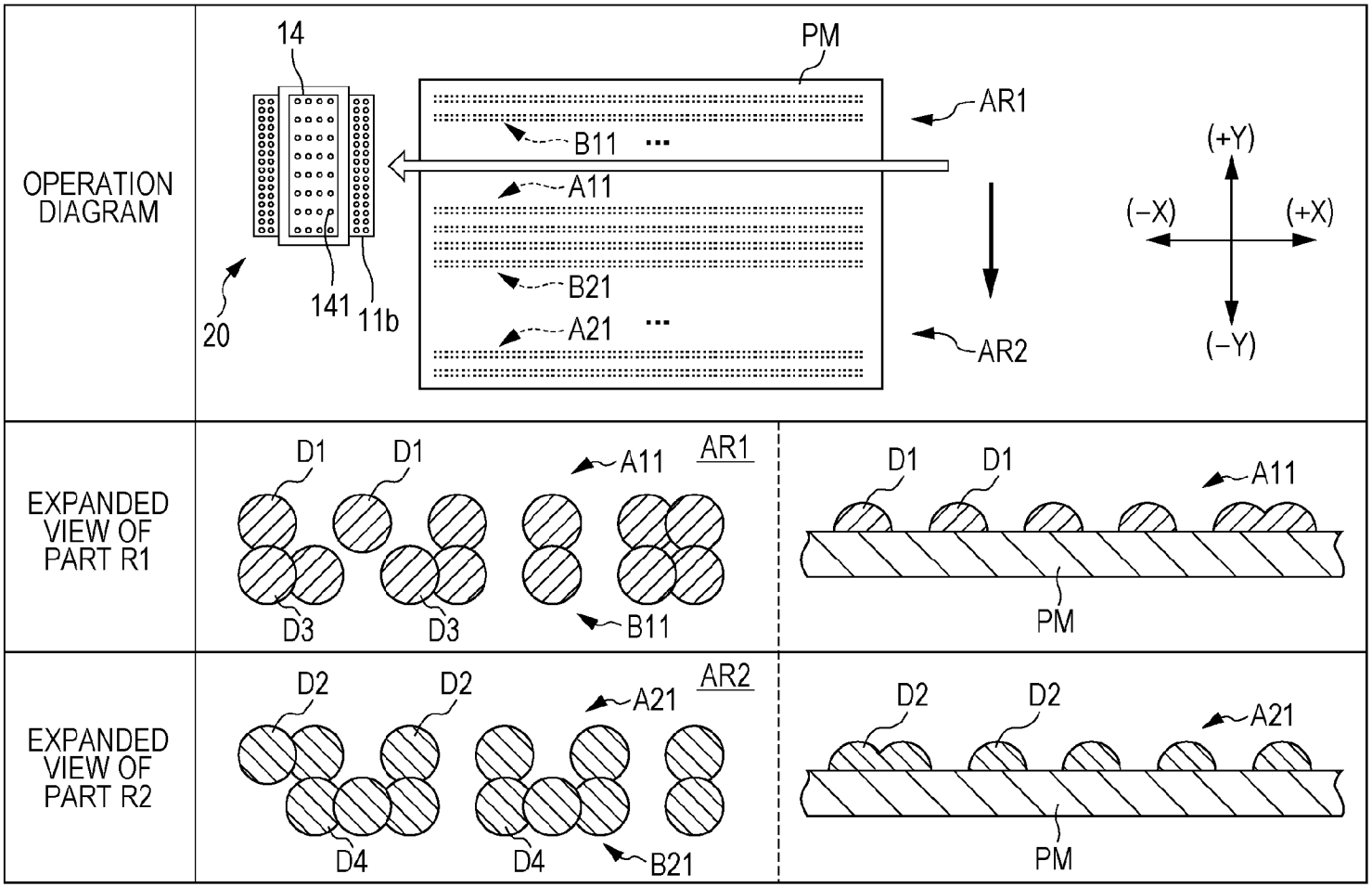
FIG. 12 is a drawing schematically showing the printing operation of the second embodiment of the printing apparatus according to the invention.

In this way, in the second embodiment, the line images A21 and B21 are continuously formed while performing backward printing and the forward printing in this order on the second area AR2. At this point in time, the head 20 is positioned at a position separated from the printing medium PM in the (+X) axis direction. In this state, by the Y-axis motor being driven by the control section 5, the stage 4 moves in the (−Y) axis direction, and the stage 4 is positioned so that the first area AR1 of the printing medium PM is positioned vertically below the reciprocation path of the head 20, and is at a position shifted in the (+Y) direction by one dot further in the Y-axis direction than during the first scanning operation. Thus, when the printing preparation for the line image B11 is completed, as shown in FIG. 12, ink is discharged from the black nozzle 141 of the print head 14 toward the surface of the first area AR1 based on the printing data provided from the control section 5 while the head 20 moves in the backward direction, that is, in the (−X) direction. The ink dots D3 are formed so as to partially overlap the line image A11 on the first area AR1 by the scanning operation. The ultraviolet ray radiating section 11*b* is lit only while moving in the backward direction in conjunction with the movement in the (−X) axis direction of the head 20, and each ink dot D3 is irradiated with ultraviolet rays. In so doing, the line image B11 in the X-axis direction is formed along with a line image B21 already formed on the second area AR2 as a second layer while curing each ink dot D3 (backward printing).

Figure 13:
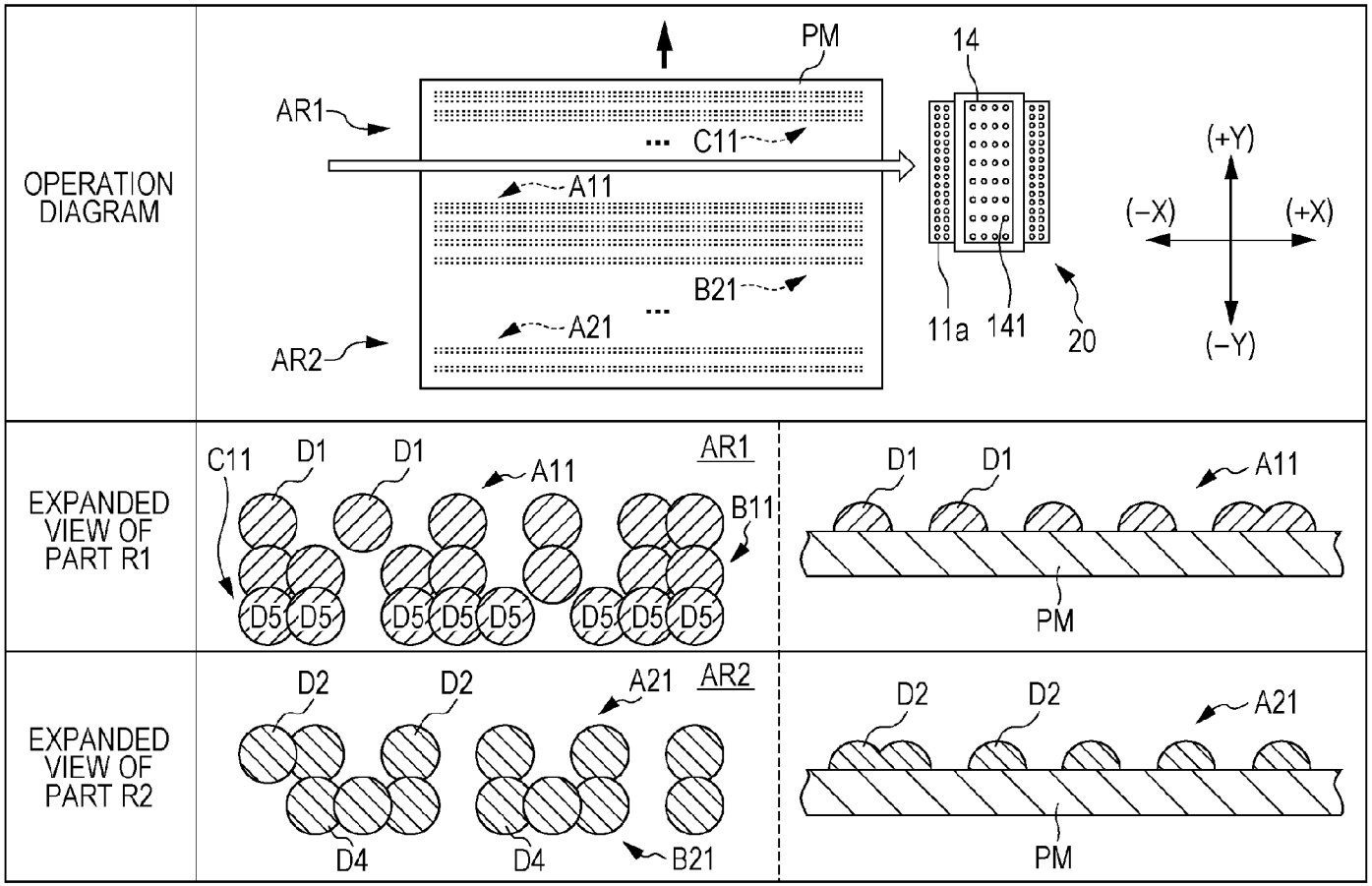
FIG. 13 is a drawing schematically showing the printing operation of the second embodiment of the printing apparatus according to the invention.

After formation of the line image B11 on the first area AR1, the next line image C11 is formed by forward printing on the same area AR1. Specifically, the Y-axis motor is driven by the control section 5, thereby moving the stage 4 in the (+Y) axis direction, and the stage 4 is positioned so that the first area AR1 of the printing medium PM is positioned at a position shifted by one dot in the (+Y) axis direction. Thus, when the printing preparation for the line image C11 is completed, as shown in FIG. 13, ink is discharged from the black nozzle 141 of the print head 14 toward the surface of the first area AR1 based on the printing data provided from the control section 5 while the head 20 moves in the forward direction, that is, in the (+X) direction. In this way, the ink dots D5 are formed so as to partially overlap the line image B11 on the first area AR1. The ultraviolet ray radiating section 11*a* is lit only while moving in the forward direction in conjunction with the movement in the (+X) axis direction of the head 20, and each ink dot D5 is irradiated with ultraviolet rays. In so doing, the line image C11 in the X-axis direction is formed as a third layer while curing each ink dot D5 (forward printing). Furthermore, formation of the remaining line images is performed similarly to above.

In this way, also in the second embodiment, the line images A11, A21, . . . D12, and D22 are formed in the order while alternately switching the area forming the line image with the print head 14 of the head 20 between the areas AR1 and AR2, similarly to the first embodiment. Therefore, gloss irregularities between areas are significantly suppressed, gloss irregularities caused by differences in the curing timing of the ink are dispersed in all regions of the printing region PR, and it is possible to achieve reductions in the gloss irregularities. As a result, it is possible to print a high quality image.

In the second embodiment, because the number of times switching of the areas is performed while transporting the printing medium PM a comparatively long distance is reduced more than in the first embodiment, an effect of improving the throughput compared to the first embodiment is obtained.

In this way, in the embodiment, the X-axis direction and the Y-axis direction correspond to the "first direction" and the "second direction" in the invention, respectively. In the embodiment, the line layer configured by the line images D12 and D22 corresponds to the "surfacemost line layer" in the invention, and the line images D12 and D22 corresponds to the "surfacemost line image" in the invention. Each of the first to seventh layers and the surfacemost layer correspond to the "line layer" in the invention, the operations forming each of the layers corresponds to an example of the "line forming operation" in the invention. The stage movement mechanism 40 corresponds to an example of the "movement section" in the invention. The stage movement for performing area switching corresponds to an example of a "first movement operation" in the invention, and the operation that switches the printing position within the area corresponds to an example of a "second movement operation" in the invention.

The invention is not limited to the above embodiments, and various modifications other than those described above are possible as long as not departing from the gist thereof. Although, in the first embodiment, one line image is formed each time the area switching is performing according to the transport of the printing medium PM, and, in the second embodiment, one or two line images are formed each time the area switching is performed, the number of line images formed for each area switching is not limited thereto, and is arbitrary.

In the first and second embodiments, although the printing region PR is divided into two areas AR1 and AR2, a configuration may be used in which the printing region PR is divided into three or more in the transport direction Y, and the area in which the line image is formed by the head 20 is switched between these areas. The number of divisions may increase as the printing region PR becomes larger.

In the first and second embodiments, although image is formed while executing eight scans on one area, the number of scans for one area is not limited to "eight", and is arbitrary. For example, the number of scans may be modified according to the recording method such as the printing resolution or the nozzle resolution.

In the first and second embodiments, area switching is performed by transporting the printing medium PM in the transport direction Y, a configuration may be used such that a configuration by which the head 20 is moved in the Y-axis direction is added to the head movement mechanism 21, and area switching is performed by the head 20 being moved in the Y-axis direction, and in this case, the head movement mechanism 21 functions as the "movement section" in the invention. In summary, a configuration may be used so that area switching is performed by the printing medium PM being relatively moved in the Y-axis direction with respect to head 20.

This application claims priority to Japanese Patent Application No. 2015-000274 filed on Jan. 5, 2015. The entire disclosure of Japanese Patent Application No. 2015-000274 is hereby incorporated herein by reference.

What is claimed is:

1. A printing apparatus that prints an image on a printing region of a printing medium, the apparatus comprising:

a head that discharges ink to the printing region, and cures ink dots, by application of light, formed on the printing region to form a line image in a first direction; and a movement section that causes the printing medium to move relative to the head in a second direction intersecting the first direction, wherein the printing region is divided into a plurality of areas in the second direction, and the movement section alternately switches the area in which the line image is formed by the head between the plurality of areas while causing the printing medium to relatively move.

2. The printing apparatus according to claim 1, wherein the head repeats a line layer formation operation in which a line layer is formed on the entire surface of the printing region through formation of a line image on each area, and layers the plurality of line layers on the printing region, and the surfacemost line image that is the line image included in a surfacemost line layer of the plurality of line layers is formed with a smaller number of ink dots than a line image other than the surfacemost line image.

3. The printing apparatus according to claim 2, wherein the head discharges the ink so that the plurality of ink dots that configures the surfacemost line image are separated from one another in the first direction.

4. The printing apparatus according to claim 2, wherein the head discharges ink so that the number of ink dots for each line layer forming operation is reduced towards the surfacemost line layer.

5. The printing apparatus according to claim 1, wherein the printing region is divided into a first area and a second area, and the head is configured so as to print an image by forming a first area line image by forming a first number of ink dots corresponding to the image on the first area and forming a second area line image by forming a second number of ink dots corresponding to the image on the second area, the first area line image is formed by forming a first line image by discharging ink with a number obtained by multiplying a discharge rate P1 (where 0%<P1<100%) by the first number on the first area, forming a second line image by discharging ink with a number obtained by multiplying a discharge rate P2 (where 0%<P2<100%) by the second number on the second area, and forming a third line image by discharging ink with a number obtained by multiplying a discharge rate (100−P1) by the first number on the first line image, and the second area line image is formed by forming a fourth line image by discharging ink with a number obtained by multiplying a discharge rate (100−P2) by the second number on the second line image.

6. The printing apparatus according to claim 5, wherein the discharge rate P1 is 60% or higher, and the discharge rate P2 is 60% or higher.

7. The printing apparatus according to claim 5, wherein the discharge rate P1 and the discharge rate P2 have the same value.

8. The printing apparatus according to claim 1, wherein the printing region is divided into a first area and a second area, and the head includes a print head that freely reciprocates in the first direction, forward printing in which a line image is formed by discharging the ink from the print head to the first area while the print head is moved in the forward direction is executed, and backward printing in which a line image is formed by discharging the ink from the print head to the second area while the print head is moved in the backward direction is executed.

9. The printing apparatus according to claim 1, wherein the printing region is divided into the first area and the second area, the head includes a print head that freely reciprocates in the first direction, and is able to execute forward printing that forms a line image by discharging the ink from the print head while the print head is moved in the forward direction, and backward printing that forms a line image by discharging the ink from the print head while the print head is moved in the backward direction, the movement section is able to execute a first movement operation in which the printing medium is relatively moved in order to switch the area for forming the line image by the head between the first area and the second area, and a second movement operation in which the printing medium is relatively moved with the area for forming the line image by the head being maintained as is, and after the forward printing, second movement operation, and the backward printing are executed to form a plurality of line images in one area of the first area and the second area, a switch is performed to the other area while executing the first movement operation.

10. The printing apparatus according to claim 1, wherein the ink is a liquid that is cured when irradiated with ultraviolet rays.

11. A printing method of printing an image on a printing region of a printing medium, the method comprising:

discharging ink to the printing region by a head, and curing ink dots, by application of light, formed on the printing region to form a line image in a first direction, and moving the printing medium relative to the head in a second direction intersecting the first direction, wherein the printing region is divided into a plurality of areas in the second direction, and the area in which the line image is formed by the discharging of the ink is alternately switched between the plurality of areas while performing the moving of the printing medium.

* * * * *